US008241200B2

(12) United States Patent
Chinn

(10) Patent No.: US 8,241,200 B2
(45) Date of Patent: Aug. 14, 2012

(54) INCUBATOR TRANSPORTER INTERFACE ASSEMBLY

(75) Inventor: Robert C. Chinn, Cumming, GA (US)

(73) Assignee: Ferno-Washington, Inc., Wilmington, OH (US)

( * ) Notice: Subject to any disclaimer, the term of this patent is extended or adjusted under 35 U.S.C. 154(b) by 857 days.

(21) Appl. No.: 12/356,633

(22) Filed: Jan. 21, 2009

(65) Prior Publication Data

US 2010/0185045 A1 Jul. 22, 2010

(51) Int. Cl.
*A61G 1/04* (2006.01)
*A61G 11/00* (2006.01)

(52) U.S. Cl. ..... 600/22; 280/638; 248/129; 248/246.06

(58) Field of Classification Search ..... 600/22; 128/897, 205.26; 5/36.4, 89.1, 611, 618, 5/430, 86.1; 414/495; 296/20; 312/209, 312/236; 280/79.11, 47.18, 47.27, 638, 35, 280/651, 79.3, 639, 47.41, 47.34; 297/69; 248/129, 136, 370, 346.06, 225.11, 277.1, 248/647, 678; 250/494.1; 188/5; 607/81; 29/181; 269/17
See application file for complete search history.

(56) References Cited

U.S. PATENT DOCUMENTS

| | | | | |
|---|---|---|---|---|
| 4,190,224 A | | 2/1980 | LeBlanc et al. | |
| 5,018,931 A | * | 5/1991 | Uttley | 414/495 |
| 5,149,030 A | | 9/1992 | Cockrill | |
| 5,772,233 A | * | 6/1998 | Papendick | 280/638 |
| 6,611,702 B2 | | 8/2003 | Rohling et al. | |

FOREIGN PATENT DOCUMENTS

| | | | |
|---|---|---|---|
| DE | 3701463 | A1 | 7/1988 |
| DE | 3719781 | C1 | 1/1989 |
| JP | 9327481 | A | 12/1997 |
| WO | 02/34191 | A1 | 5/2002 |

OTHER PUBLICATIONS

Ferno Aviation, Inc., Custom 35-IT Stretcher w/R3 Isolette Adapter, 2002, [online], [retrieved on Jun. 30, 2009] Retrieved from the Ferno Aviation, Inc., website using Internet <URL: http:/www.aviation.ferno.com/products/custom/35itr3.html>.

Ferno Aviation, Inc., Airborne Isolette Adapter for 35-IT Stretcher, 2002, [online], [retrieved on Jun. 30, 2009] Retrieved from the Ferno Aviation, Inc., website using Internet <URL: http://www.aviation.ferno.com/products/misc/abdapter.html>.

* cited by examiner

*Primary Examiner* — Charles A Marmor, II
*Assistant Examiner* — Shannon Canty
(74) *Attorney, Agent, or Firm* — Dinsmore & Shohl LLP

(57) ABSTRACT

An incubator transporter interface assembly for releasably securing an incubator to a transporter is provided. The interface assembly includes equipment mounts that pivot together between an engaging position and a disengaging position so as to engage and disengage, respectively, the incubator to and from a secured state with the interface assembly.

18 Claims, 4 Drawing Sheets

INCUBATOR TRANSPORTER INTERFACE ASSEMBLY

FIELD OF THE INVENTION

The present invention relates generally to the interfacing of an incubator and a transporter, such as an emergency stretcher, and more particularly, via an incubator transporter interface assembly having interface support brackets interlocked with locking bars.

BACKGROUND OF THE INVENTION

Conventional incubators tend to be large and bulky machines and may be difficult to transport and maneuver. These characteristics make providing and transporting incubators particularly problematic in emergency situations that often occur outside of a medical facility. Prior art approaches to transporting incubators include the use of a transporter, such as a stretcher. These approaches, however, fail to provide an interface to facilitate the supporting of the incubator on the transporter and that includes pivotable connectors that releasably engage and secure the incubator while supported on the transporter.

SUMMARY OF THE INVENTION

It is against the above background that the present invention provides an incubator transporter interface assembly releasably securable to a transporter and that includes equipment mounts that pivot together between an engaging position and a disengaging position so as to engage and disengage, respectively, the incubator to and from a secured state with the interface assembly.

In accordance with one embodiment of the present invention, an incubator transporter interface assembly for releasably securing an incubator to a transporter, comprising: a plurality of parallel interface support brackets to support the incubator on the transporter, wherein the interface support brackets respectively comprise a plurality of slots; a plurality of parallel locking bars to secure the incubator in a secured state with the incubator transporter interface assembly, wherein the locking bars pass through the slots of the interface support brackets and respectively comprise at least one equipment mount; and a pivoting mechanism to facilitate simultaneous bi-directional actuation of the locking bars along opposite directional paths through the slots of the interface support brackets, wherein the pivoting mechanism comprises a stationary bar and a pivot bar that couples the locking bars with the stationary bar. Actuation of a first of the locking bars in a directional path pivots the pivot bar about a connection with the stationary bar such that the pivot bar actuates another of the locking bars in an opposite directional path simultaneously with actuation of the first of the locking bars. In addition, actuation of the locking bars pivot the equipment mounts together between a position for engaging the incubator in the secured state with the incubator transporter interface assembly and a position for disengaging the incubator from the secured state with the incubator transporter interface assembly.

In accordance with another embodiment of the present invention, an incubator transporter interface assembly for releasably securing an incubator to a transporter, comprising: a plurality of parallel interface support brackets to support the incubator on the transporter, wherein the interface support brackets respectively comprise a plurality of slots and at least one guide pin, and wherein the guide pins guide positioning of the incubator on the interface support brackets; a plurality of releasable clamps that releasably secure the interface support brackets to the transporter; a plurality of parallel locking bars to secure the incubator in a secured state with the incubator transporter interface assembly, wherein the locking bars pass through the slots of the interface support brackets and respectively comprise at least one equipment mount; and a pivoting mechanism to facilitate simultaneous bidirectional actuation of the locking bars along opposite directional paths through the slots of the interface support brackets, wherein the pivoting mechanism comprises a stationary bar and a pivot bar that couples the locking bars with the stationary bar. Actuation of a first of the locking bars in a directional path pivots the pivot bar about a connection with the stationary bar such that the pivot bar actuates another of the locking bars in an opposite directional path simultaneously with actuation of the first of the locking bars. In addition, actuation of the locking bars pivot the equipment mounts together between a position for engaging the incubator in a secured state with the incubator transporter interface assembly and a position for disengaging the incubator from the secured state with the incubator transporter interface assembly. Further, the equipment mounts engage recesses of the incubator to prevent vertical movement of the incubator in the secured state with the incubator transporter interface assembly and the guide pins engage depressions of the incubator to prevent lateral movement of the incubator.

In accordance with yet another embodiment of the present invention, a method of releasably securing an incubator to a transporter comprises: providing an incubator transporter interface assembly comprising a plurality of parallel interface support brackets, a plurality of releasable clamps, a plurality of parallel locking bars, and a pivoting mechanism; releasably securing the releasable clamps about longitudinally extending supports of the transporter such that the interface assembly is releasably secured to the transporter; positioning the incubator on the interface support brackets such that guide pins of the interface support brackets engage depressions in the incubator; actuating a first of the locking bars in a directional path through slots of the interface support brackets such that a pivot bar of the pivoting mechanism coupling the locking bars actuates another of the locking bars in an opposite directional path simultaneously with actuation of the first of the locking bars; and pivoting together equipment mounts respective to the locking bars to a position for engaging the incubator in a secured state with the incubator transporter interface assembly such that the incubator is releasably secured to the transporter.

In accordance with another embodiment of the present invention, the method of releasably securing an incubator to a transporter further comprises: re-actuating the first of the locking bars to return along the directional path such that the pivot bar re-actuates another of the locking bars to return along the opposite directional path simultaneously with re-actuation of the first of the locking bars; and pivoting together the equipment mounts to a position for disengaging the incubator from the secured state with the incubator transporter interface assembly such that the incubator is not releasably secured to the transporter.

BRIEF DESCRIPTION OF THE DRAWINGS

The following detailed description of the various embodiments of the present invention can be best understood when read in conjunction with the following drawings, where like structure is indicated with like reference numerals and in which.

Figure 1:
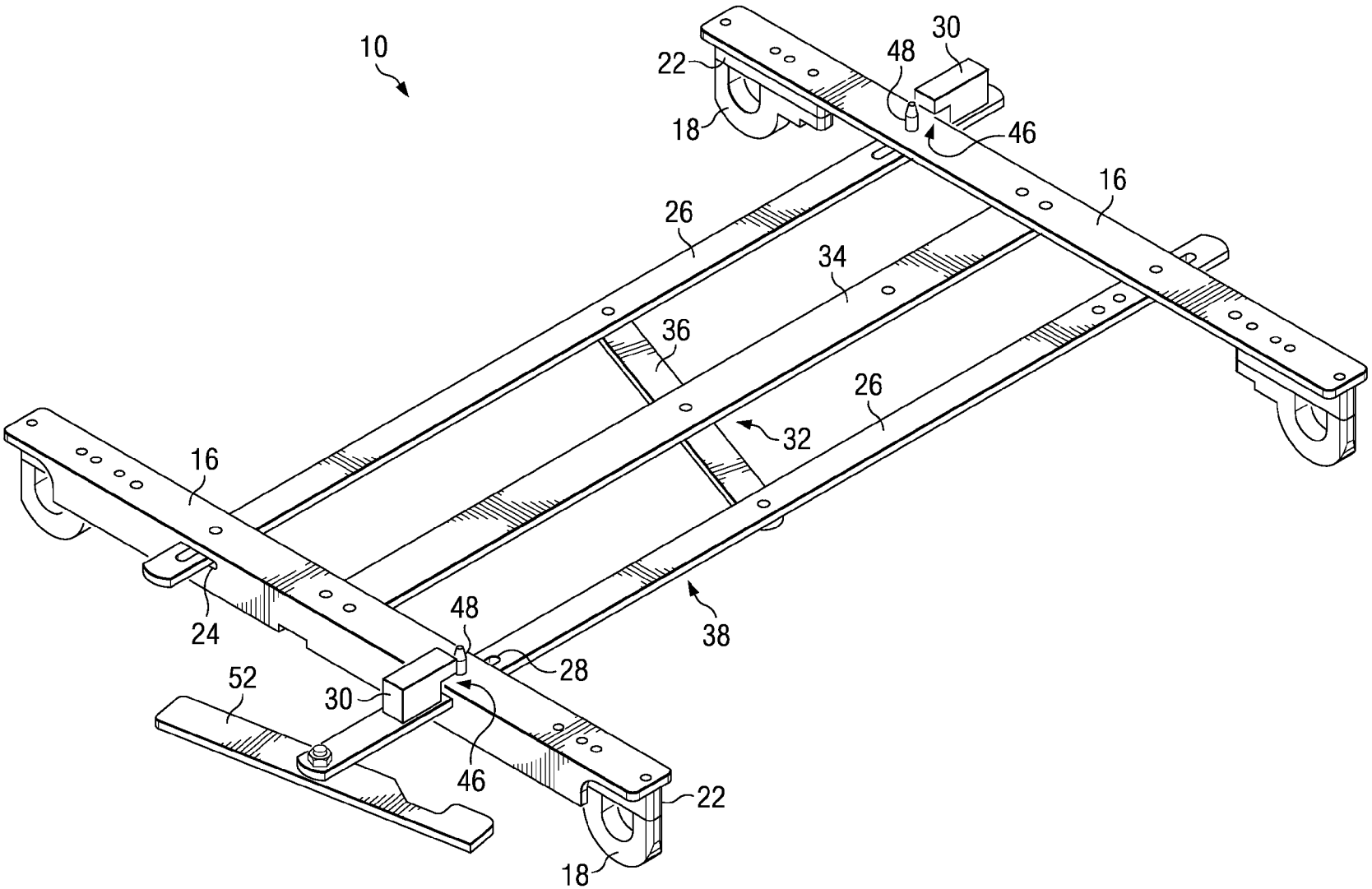
FIG. 1 is an illustration of an incubator transporter interface assembly according to one embodiment of the present invention.

The embodiments set forth in the drawings are illustrative in nature and are not intended to be limiting of the invention defined by the claims. Moreover, individual aspects of the drawings and the invention will be more fully apparent and understood in view of the detailed description.

DETAILED DESCRIPTION

Figure 3:
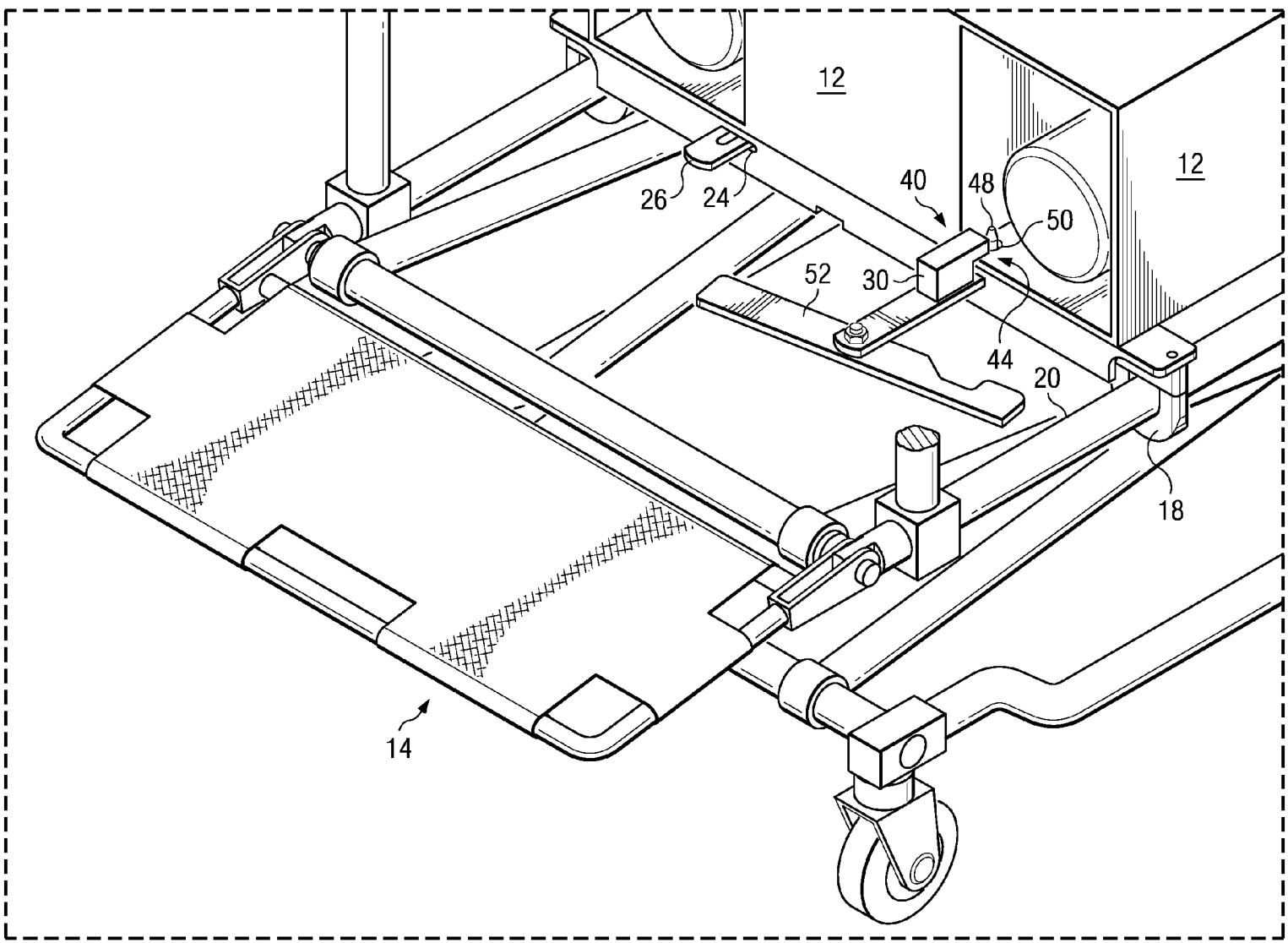
FIG. 3 is an illustration of a locking bar and an equipment mount in a position for engaging an incubator in a secured state with an emergency stretcher according to another embodiment of the present invention.
Figure 4:
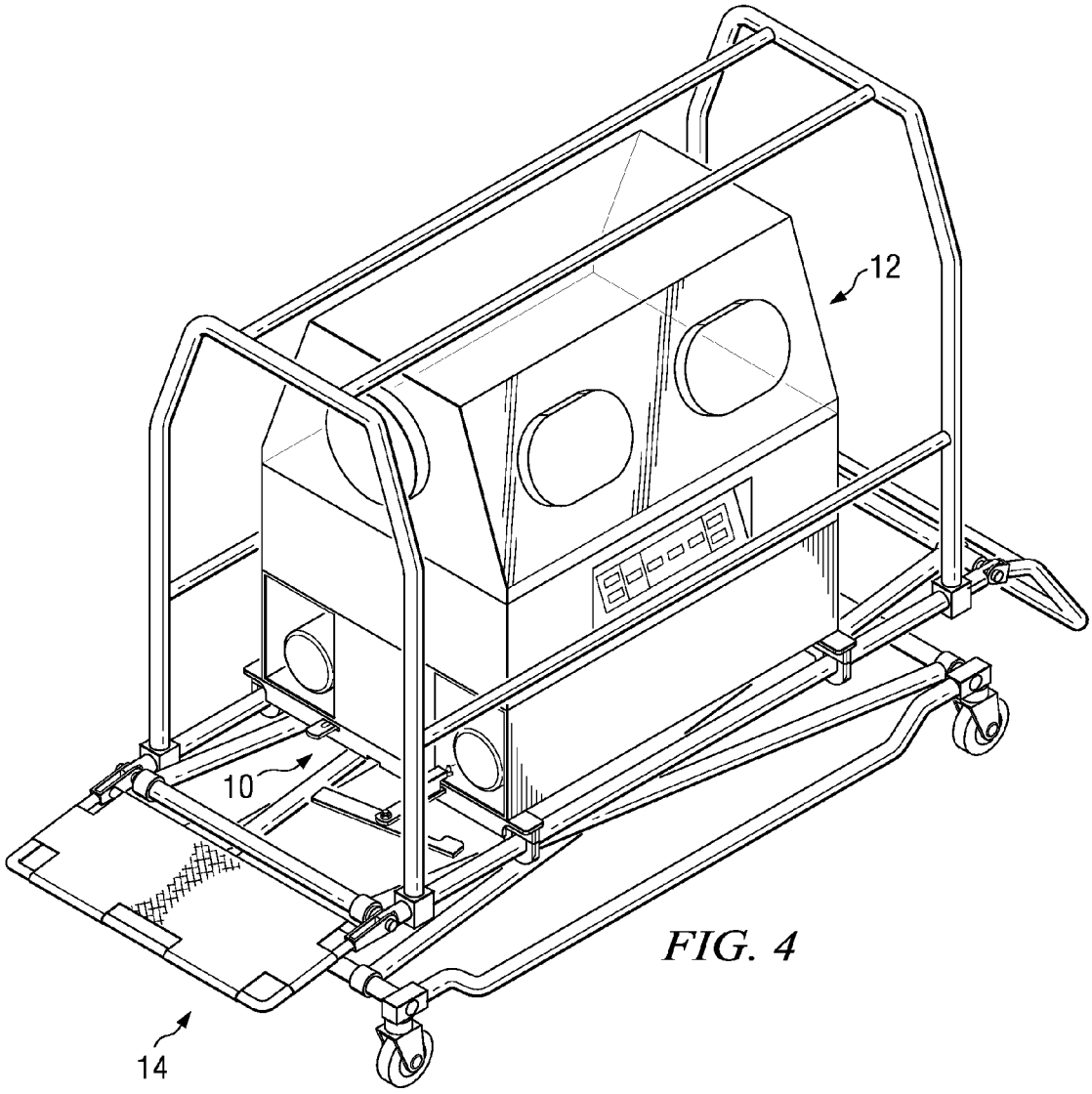
FIG. 4 is an illustration of an incubator secured to an emergency stretcher via an incubator transporter interface assembly according to another embodiment of the present invention.

Referring initially to FIG. 4, embodiments of the present invention relate generally to assemblies 10 for interfacing an incubator 12 and a transporter 14. The interfacing of incubators 12 with transporters 14 via interface assemblies 10 of the present invention enhances mobilization and facilitates use of incubators 12, particularly in emergency situations when transport of incubators in emergency vehicles, such as ground ambulances and aircraft, may be necessary. As used herein, incubators generally, but not necessarily, refer to infant incubators for environmental stabilization and the provision of medical care. As further used herein, transporters refer generally to any supportive object operable to facilitate transportation of an incubator 12. Such objects include, but are not limited to, stretchers, gurneys, cots, carts, sleds, transport decks, utility decks, etc. For example, in one embodiment shown in FIGS. 2-4, the transporter 14 is a height adjustable, emergency stretcher 14 for the provision of medical care and the transportation of patients.

As shown in FIG. 1, an incubator transporter interface assembly 10 comprises a plurality of parallel, or substantially parallel, interface support brackets 16 to support an incubator 12 upon the transporter 14. Generally two interface support brackets 16 are provided in the interface assembly 10, however, it is contemplated that more than two may be provided in a parallel, or substantially parallel, orientation.

The interface assembly 10 also generally comprises a plurality of releasable clamps 18. In one exemplary embodiment, four releasable clamps 18 are provided, wherein one releasable clamp 18 is provided to each opposing end of two interface support brackets 16. These releasable clamps 18 generally are secured to a respective underside of the interface support brackets 16 and releasably secure the interface support brackets 16 to the transporter 14. More particularly, in one exemplary embodiment shown in FIGS. 2-4, the releasable clamps 18 releasably secure about one or more longitudinally extending supports 20 of the transporter 14 such that the interface support brackets 16 are releasably secured to the transporter 14. Further, in the exemplary embodiment shown in FIGS. 1-4, the interface support brackets 16 are configured as right angle brackets 16. To compensate for any gaps that may exist between right angle, or otherwise configured, interface support brackets 16 and the longitudinally extending supports 20 of the transporter 14, the interface assembly 10 may further comprise a plurality of spacers 22 positioned between the underside of the interface support brackets 16 and the releasable clamps 18 secured thereto. It is contemplated that the interface support brackets 16 may be configured in any angular or polygonal shape so long as they sufficiently perform the functions described herein.

Figure 2:
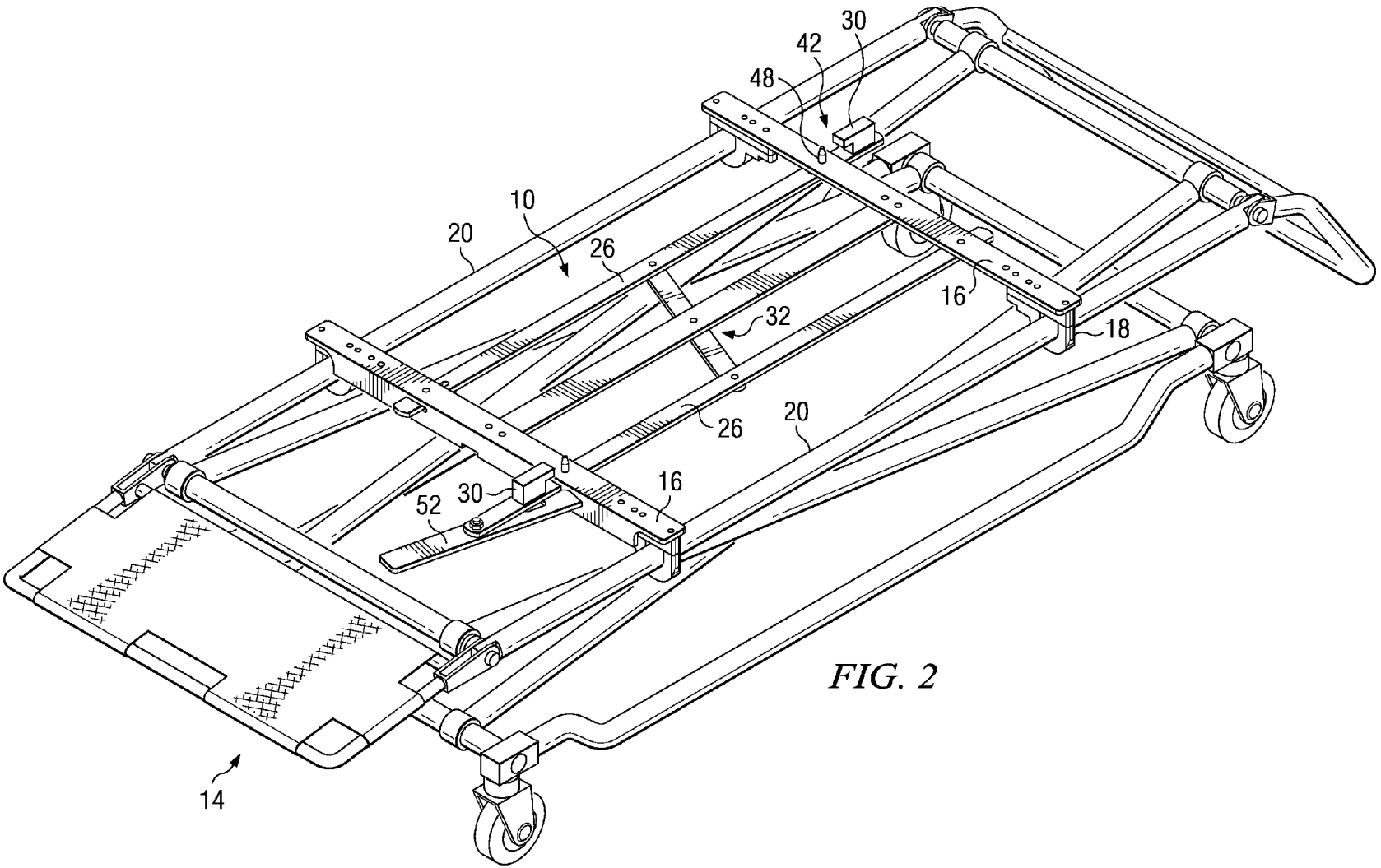
FIG. 2 is an illustration of an incubator transporter interface assembly secured to an emergency stretcher according to another embodiment of the present invention.

The interface support brackets 16 that support the incubator 12 upon the transporter 14 respectively comprise a plurality of slots 24, as shown in FIGS. 1-3. These slots 24 generally are aligned such that the slots 24 in one interface support bracket 16 are parallel, or substantially parallel, with the slots 24 in another interface support bracket 16. It is through these slots 24 that a plurality of locking bars 26 of the interface assembly 10 pass. Generally, two locking bars 26 actuate through the slots 24 of the interface support brackets 16 in order to secure and release the incubator 12 to and from the interface assembly 10. The locking bars 26 respectively may comprise one or more grooves 28 into or through which a pin of the interface support brackets 16 may pass to prevent over-actuation of the locking bars 26 to ensure that they do not slide out of or otherwise become dislodged from the slots 24 of the incubator support brackets 16. Further, the locking bars 26 respectively comprise at least one equipment mount 30 for engaging the incubator 12 through actuation of the locking bars 26 and their respective equipment mounts 30.

A pivoting mechanism 32 of the interface assembly 10 facilitates simultaneous bi-directional actuation of the locking bars 26 along opposite directional paths through the slots 24 of the interface support brackets 16. More particularly, the pivoting mechanism 32 comprises a stationary bar 34 and a pivot bar 36 that couples the locking bars 26 with the stationary bar 34. Generally, the stationary bar 34 is parallel with, and positioned between, the locking bars 26. Actuation of a first 38 of the locking bars 26 in a directional path pivots the pivot bar 36 about a connection with the stationary bar 34. Thereby, the pivot bar 36 actuates another of the locking bars 26 in an opposite directional path simultaneously with the actuation of the first 38 of the locking bars 26.

This actuation of the locking bars 26 pivot together their respective equipment mounts 30 between a position 40 for engaging the incubator 12 in a secured state with the interface assembly 10 and a position 42 for disengaging the incubator 12 from the secured state with the interface assembly 10. For example, but not by way of limitation, the equipment mounts 30 may engage and disengage recesses 44, such as, but not limited to, cavities, depressions, apertures, etc., of the incubator 12 when pivoted between the engaging position 40 and the disengaging position 42, respectively, such that the incubator 12 is engaged and disengaged from a secured state with the interface assembly 10. In one exemplary embodiment, the equipment mounts 30 comprise dovetail connective surfaces 46 that engage recesses 44 of the incubator 12 to prevent vertical movement of the incubator 12 in the secured state with the interface assembly 10.

The interface support brackets 16 also may respectively comprise at least one guide pin 48, as shown in FIGS. 1-3. These guide pins 48 may engage depressions 50, such as, but not limited to, cavities, recesses, apertures, etc., of the incubator 12. When engaged with the incubator depressions 50, the guide pins 48 may prevent lateral movement of the incubator 12 over the interface support brackets 16, regardless of whether the incubator 12 is in the secured state with the interface assembly 10 via the equipment mounts 30. Further, the guide pins 48 may guide positioning of the incubator 12 on the interface support brackets 16 by indicating where the incubator 12 should be positioned on the interface support brackets 16 such that the guide pins 48 engage the depressions 50 of the incubator and such that the recesses 44 of the incubator 12 are properly aligned for engagement and disengagement with the pivoting equipment mounts 30.

As shown in FIGS. 1-3, the interface assembly 10 may also comprise a release handle 52. The release handle 52 generally is rotatably coupled to the first 38 of the locking bars 26. The release handle 52 may facilitate actuation of the first 38 of the locking bars 26 by providing a hand grip accessible to a user of the interface assembly 10. More particularly, the release handle 52 may facilitate the actuation of the locking bars 26 and the pivoting of the equipment mounts 30 between the engaging position 40 and the disengaging position 42 with the incubator 12. The release handle 52 may facilitate the pivoting of the equipment mounts 30 to the engaging position 40 by enabling the user to more easily actuate the first 38 of the locking bars 26 toward the interface support bracket 16 and the incubator 12 supported thereon. Meanwhile, the release handle 52 may facilitate the pivoting of the equipment mounts 30 to the disengaging position 42 by enabling the user to rotate the release handle 52 such that it butts up against the interface support bracket 16, as shown in FIG. 2, and allows the user to torque the release handle 52 against the interface support bracket 16 to actuate the equipment mounts 30 to the disengaging position 42. This may be particularly useful should one or more of the equipment mounts 30 become frictionally lodged in the engaging position 40 with the incubator 12. The release handle 52 may be torqued against the interface support brackets 16 to drive a separation between the lodged equipment mounts 30 and the incubator 12. Thus, based on the foregoing, it is contemplated that a single release handle 52 may be rotated by a user to pivot simultaneously one or more equipment mounts 30 to respective disengaging positions 42, thereby permitting a quick-release of the incubator 12 from the interface assembly 10 and the transporter 14.

In accordance with one exemplary embodiment, when a user desires to use an embodiment of the incubator transporter interface assembly 10 to interface an incubator 12 with an emergency stretcher 14, the user first releasably secures the interface assembly 10 to the emergency stretcher 14. The user does so by positioning four open releasable clamps 18 about the longitudinal extending supports 20 of the emergency stretcher 14 and closing the four positioned releasable clamps 18 thereabout. The user then positions the incubator 12 on the interface support brackets 16 such that the guide pins 48 engage the depressions 50 on the underside of the incubator 12. Once the incubator 12 is positioned over the guide pins 48, the user grips the release handle 52 and actuates a first 38 of two locking bars 26 such that the equipment mount 30 pivots toward the engaging position 26 with the incubator 12. Thereby, the pivot bar 36 pivots about its connection with the stationary bar 34 and actuates a second of the two locking bars 26 simultaneously with the actuation of the first 38 of the two locking bars 26. With the actuation of the two locking bars 26, the equipment mounts 30 pivot to the engaging position 40 to engage the incubator 12 in a secured state with the interface assembly 40. As such, the incubator 12 positioned over the guide pins 48 and engaged by the equipment mounts 30 is prevented from moving laterally or vertically over the interface assembly 10 and the emergency stretcher 14. To release the incubator 12 from the secured state with the interface assembly 10, the user simply grips the release handle 52 and actuates the locking bars 26, and the respective equipment mounts 30, to the disengaging position 42 so that the incubator 12 may be lifted off from over the guide pins 48 and removed from the interface assembly 10 and the emergency stretcher 14. The interface assembly 10 may then be removed from the emergency stretcher 14 by releasing the releasable clamps 18 from the closed, secured position and lifting the interface assembly 10 from the emergency stretcher 14.

It is noted that recitations herein of a component of the present invention being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally" and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present invention or to emphasize alternative or additional features that may or may not be utilized in a particular embodiment of the present invention.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

The foregoing description of the invention has been presented for purposes of illustration and description. It is not intended to be exhaustive or to limit the invention to the precise form disclosed, and other modifications and variations may be possible in light of the above teachings. The above embodiments disclosed were chosen and described to explain the principles of the invention and its practical application to thereby enable others skilled in the art to best utilize the invention. It is intended that the appended claims be construed to include other alternative embodiments of the invention except insofar as limited by the prior art. Therefore, having described the invention in detail and by reference to specific embodiments thereof, it will be apparent that modifications and variations are possible without departing from the scope of the invention defined in the appended claims.

What is claimed is:

1. An incubator transporter interface assembly for releasably securing an incubator to a transporter, comprising:

a plurality of parallel interface support brackets to support the incubator on the transporter, wherein the interface support brackets respectively comprise a plurality of slots;

a plurality of parallel locking bars to secure the incubator in a secured state with the incubator transporter interface assembly, wherein the locking bars pass through the slots of the interface support brackets and respectively comprise at least one equipment mount; and a pivoting mechanism to facilitate simultaneous bidirectional actuation of the locking bars along opposite directional paths through the slots of the interface support brackets, wherein the pivoting mechanism comprises a stationary bar and a pivot bar that couples the locking bars with the stationary bar, wherein actuation of a first of the locking bars in a directional path pivots the pivot bar about a connection with the stationary bar such that the pivot bar actuates another of the locking bars in an opposite directional path simultaneously with actuation of the first of the locking bars, and wherein actuation of the locking bars pivot the equipment mounts together between a position for engaging the incubator in the secured state with the incubator transporter interface assembly and a position for disengaging the incubator from the secured state with the incubator transporter interface assembly.

2. The incubator transporter interface assembly of claim 1, wherein the equipment mounts engage and disengage recesses of the incubator when pivoted between the engaging position and the disengaging position, respectively, such that the incubator is engaged and disengaged from the secured state with the incubator transporter interface assembly.

3. The incubator transporter interface assembly of claim 2, wherein the equipment mounts comprise dovetail connective surfaces that engage the recesses of the incubator to prevent vertical movement of the incubator in the secured state with the incubator transporter interface assembly.

4. The incubator transporter interface assembly of claim 1, wherein the interface support brackets respectively comprise at least one guide pin that engage depressions of the incubator to prevent lateral movement of the incubator.

5. The incubator transporter interface assembly of claim 4, wherein the guide pins guide positioning of the incubator on the interface support brackets for the pivoting of the equipment mounts to the engaging position with the incubator.

6. The incubator transporter interface assembly of claim 1, wherein the incubator transporter interface assembly further comprises a release handle coupled to the first of the locking bars such that the release handle facilitates actuation of the locking bars.

7. The incubator transporter interface assembly of claim 1, wherein the stationary bar is parallel with, and positioned between, the locking bars.

8. The incubator transporter interface assembly of claim 1, wherein the incubator transporter interface assembly further comprises a plurality of releasable clamps that releasably secure the interface support brackets to the transporter.

9. The incubator transporter interface assembly of claim 8, wherein the releasable clamps releasably secure about one or more longitudinally extending supports of the transporter.

10. The incubator transporter interface assembly of claim 9, wherein:

the incubator transporter interface assembly further comprises a plurality of spacers positioned between the interface support brackets and the releasable clamps, and the spacers compensate for any gap between the interface support brackets and the longitudinally extending supports of the transporter.

11. The incubator transporter interface assembly of claim 1, wherein the transporter is an emergency stretcher.

12. An incubator transporter interface assembly for releasably securing an incubator to a transporter, comprising:

a plurality of parallel interface support brackets to support the incubator on the transporter, wherein the interface support brackets respectively comprise a plurality of slots and at least one guide pin, and wherein the guide pins guide positioning of the incubator on the interface support brackets;

a plurality of releasable clamps that releasably secure the interface support brackets to the transporter;

a plurality of parallel locking bars to secure the incubator in a secured state with the incubator transporter interface assembly, wherein the locking bars pass through the slots of the interface support brackets and respectively comprise at least one equipment mount; and a pivoting mechanism to facilitate simultaneous bidirectional actuation of the locking bars along opposite directional paths through the slots of the interface support brackets, wherein the pivoting mechanism comprises a stationary bar and a pivot bar that couples the locking bars with the stationary bar, wherein actuation of a first of the locking bars in a directional path pivots the pivot bar about a connection with the stationary bar such that the pivot bar actuates another of the locking bars in an opposite directional path simultaneously with actuation of the first of the locking bars, wherein actuation of the locking bars pivot the equipment mounts together between a position for engaging the incubator in a secured state with the incubator transporter interface assembly and a position for disengaging the incubator from the secured state with the incubator transporter interface assembly, wherein the equipment mounts engage recesses of the incubator to prevent vertical movement of the incubator in the secured state with the incubator transporter interface assembly, and wherein the guide pins engage depressions of the incubator to prevent lateral movement of the incubator.

13. The incubator transporter interface assembly of claim 12, wherein the incubator transporter interface assembly further comprises a release handle coupled to the first of the locking bars such that the release handle facilitates actuation of the locking bars.

14. The incubator transporter interface assembly of claim 12, wherein the equipment mounts comprise dovetail connective surfaces that engage the recesses of the incubator in the secured state with the incubator transporter interface assembly.

15. A method of releasably securing an incubator to a transporter, the method comprising:

providing an incubator transporter interface assembly comprising a plurality of parallel interface support brackets, a plurality of releasable clamps, a plurality of parallel locking bars, and a pivoting mechanism;

releasably securing the releasable clamps about longitudinally extending supports of the transporter such that the interface assembly is releasably secured to the transporter;

positioning the incubator on the interface support brackets such that guide pins of the interface support brackets engage depressions in the incubator;

actuating a first of the locking bars in a directional path through slots of the interface support brackets such that a pivot bar of the pivoting mechanism coupling the locking bars actuates another of the locking bars in an opposite directional path simultaneously with actuation of the first of the locking bars; and pivoting together equipment mounts respective to the locking bars to a position for engaging the incubator in a secured state with the incubator transporter interface assembly such that the incubator is releasably secured to the transporter.

16. The method of claim 15, wherein the method further comprises:

re-actuating the first of the locking bars to return along the directional path such that the pivot bar re-actuates another of the locking bars to return along the opposite directional path simultaneously with re-actuation of the first of the locking bars; and pivoting together the equipment mounts to a position for disengaging the incubator from the secured state with the incubator transporter interface assembly such that the incubator is not releasably secured to the transporter.

17. The incubator transporter interface assembly of claim 1, wherein the locking bars respectively comprise one or more grooves into or through which a pin of the interface support brackets may pass to ensure that the locking bars do not become dislodged from the slots of the incubator support brackets.

18. The incubator transporter interface assembly of claim 12, wherein the locking bars respectively comprise one or more grooves into or through which a pin of the interface support brackets may pass to ensure that the locking bars do not become dislodged from the slots of the incubator support brackets.

* * * * *